US008282348B2

(12) United States Patent
Carl, Jr. et al.

(10) Patent No.: US 8,282,348 B2
(45) Date of Patent: Oct. 9, 2012

(54) FAN WITH STRUT-MOUNTED ELECTRICAL COMPONENTS

(75) Inventors: Ralph J. Carl, Jr., Clifton Park, NY (US); John Decker, Cypress, TX (US); Chellappa Balan, Niskayuna, NY (US)

(73) Assignee: Xcelaero Corporation, San Luis Obispo, CA (US)

( * ) Notice: Subject to any disclaimer, the term of this patent is extended or adjusted under 35 U.S.C. 154(b) by 1217 days.

(21) Appl. No.: 12/074,624

(22) Filed: Mar. 4, 2008

(65) Prior Publication Data

US 2008/0219841 A1 Sep. 11, 2008

Related U.S. Application Data

(60) Provisional application No. 60/905,152, filed on Mar. 5, 2007.

(51) Int. Cl.
*F04B 19/00* (2006.01)

(52) U.S. Cl. ..... 415/209.4; 415/210.1; 415/211.2; 417/423.14

(58) Field of Classification Search ..... 415/191, 415/208.1, 208.2, 209.2–209.4, 210.1, 211.2; 417/352–354, 423.1–423.14
See application file for complete search history.

(56) References Cited

U.S. PATENT DOCUMENTS

| | | | | | |
|---|---|---|---|---|---|
| 3,995,970 | A * | 12/1976 | Nobuyuki | 415/119 |
| 4,123,197 | A * | 10/1978 | Keem et al. | 415/123 |
| 4,475,867 | A * | 10/1984 | Smith | 415/119 |
| 4,578,605 | A | 3/1986 | Reinhardt et al. | |
| 4,692,091 | A * | 9/1987 | Ritenour | 415/119 |
| 4,780,052 | A * | 10/1988 | Pradelle | 415/119 |
| 6,638,037 | B2 * | 10/2003 | Grant | 417/423.15 |
| 2002/0110456 | A1 * | 8/2002 | Bussa | 416/204 R |
| 2005/0098641 | A1 * | 5/2005 | Ardelt et al. | 236/49.3 |
| 2005/0106046 | A1 | 5/2005 | Winkler | |
| 2010/0117468 | A1 | 5/2010 | Kurita | |

FOREIGN PATENT DOCUMENTS

| | | |
|---|---|---|
| EP | 1 138 242 A2 | 10/2001 |
| JP | 04-327731 | 11/1992 |
| JP | 05-260693 | 10/1993 |
| JP | 08-042875 | 2/1996 |
| JP | 2002-021794 | 1/2002 |
| JP | 2002-112499 | 4/2002 |
| JP | 2004-159381 | 6/2004 |
| JP | 2006-034073 | 2/2006 |

* cited by examiner

*Primary Examiner* — Edward Look
*Assistant Examiner* — Christopher R Legendre
(74) *Attorney, Agent, or Firm* — Henry C. Query, Jr.

(57) ABSTRACT

A cooling fan having a fan housing, a motor which is positioned within the fan housing and a plurality of electronics components which are associated with the motor includes at least one strut which extends radially between the motor and the fan housing and on which the electronics components are mounted.

36 Claims, 3 Drawing Sheets

FAN WITH STRUT-MOUNTED ELECTRICAL COMPONENTS

This application is based on and claims the benefit of U.S. Provisional Patent Application No. 60/905,152, which was filed on Mar. 5, 2007.

BACKGROUND OF THE INVENTION

The present invention relates to a vane axial fan which includes a motor that is supported at least partially within a fan housing by one or more radial struts. More specifically, the invention relates to a vane axial fan in which at least a portion of the power electronics components for the motor are mounted on one of the struts.

Variable speed, high efficiency vane-axial fans often include power electronics for generating the current required to drive the motor. Typically, the power electronics components are located inside the motor housing, which is suspended inside the fan housing by a series of radial struts. However, this arrangement has several disadvantages. For example, the power electronics components take up space which could otherwise be used for a larger, more efficient motor. In addition, the heat generated by the power electronics components must be dissipated through the same heat transfer path as the heat generated by the motor. Furthermore, the size of the circuit board on which the power electronics components are mounted is limited to the maximum diameter of the motor.

SUMMARY OF THE INVENTION

In accordance with one embodiment of the present invention, a cooling fan is provided which comprises a fan housing, a motor which is positioned within the fan housing, a plurality of electronics components which are associated with the motor, and at least one strut which extends radially between the motor and the fan housing and on which the electrical components are mounted.

In accordance with another embodiment of the present invention, the motor comprises a motor housing and the strut is connected between the motor housing and the fan housing.

In accordance with a further embodiment of the invention, the cooling fan also comprises an outlet guide vane assembly which includes an inner hub that is connected to or formed integrally with the motor housing, an outer ring which is connected to or formed integrally with the fan housing, and a plurality of guide vanes which extend radially between the inner hub and the outer ring. In this arrangement, the motor is supported within the fan housing by both the outlet guide vane assembly and the strut.

In accordance with yet another embodiment of the invention, the cooling fan also comprises a diffuser section which includes a diffuser tube that is connected to or formed integrally with the fan housing and a tail cone that is connected to or formed integrally with the motor housing. In this arrangement, the strut is connected between the motor housing and the diffuser tube.

In accordance with a further embodiment of the invention, the strut may comprise a printed circuit board and the motor may comprise a daughter board to which the strut is electrically connected.

In accordance with yet another embodiment of the present invention, the strut is mechanically and electrically connectable to an edge connector of a separate printed circuit board.

Thus, in accordance with one aspect of the present invention, the radial strut which is used to support the motor in the fan housing comprises a circuit board, and at least a portion of the electronics components for the fan motor are mounted on this strut. This arrangement has several advantages. For example, the space within the motor housing that otherwise would be occupied by the electronics components can now be used to accommodate a longer, more efficient motor. Also, the electronics components may now be located in the air stream generated by the fan, which enhances the cooling of the components. Additionally, the size of the circuit board is not limited by the diameter of the motor housing, which allows the circuit board to be sized to accommodate more electronic components and their interconnects.

In addition, the circuit board can be designed as an edge connector so that the fan can be mounted to a mother board in the same manner as other edge connector components. This is an advantage when the fan is used to cool computer mother boards, especially those in computer servers, because a conventional mother board may have several fans mounted in several locations to manage the air flow through the computer system.

The present invention is particularly useful in fans with high power densities, such as a 30 watt fan which is utilized in a 1 U (40 mm) electronics rack. This is due to the fact that such fans require high power density motors and high power electronics in a relatively small volume. In addition, these fans utilize a diffuser section which limits the available space within the fan for the power electronics components.

For example, a conventional fan for a 1 U application may require approximately 8 watts. In comparison, high efficiency, high power fans utilizing outlet guide vanes, diffusers and advance aerodynamics may consume 30 watts, while increasing the energy imparted to the air flow by ten times. However, both fans must occupy similar volumes. Therefore, the power density of the fan with the advanced aerodynamic capability is higher than that of the conventional fan.

The objects and advantages of the present invention will be made apparent from the following detailed description, with reference to the accompanying drawings. In the drawings, the same reference numbers are used to denote similar components in the various embodiments.

DETAILED DESCRIPTION OF THE INVENTION

The present invention is applicable to a variety of air movers. However, for purposes of brevity it will be described in the context of an exemplary vane-axial cooling fan which is suitable for use in a 1 U rack server. Nevertheless, the person of ordinary skill in the art will readily appreciate how the teachings of the present invention can be applied to other types of air movers. Therefore, the following description should not be construed to limit the scope of the present invention in any manner.

Figure 1:
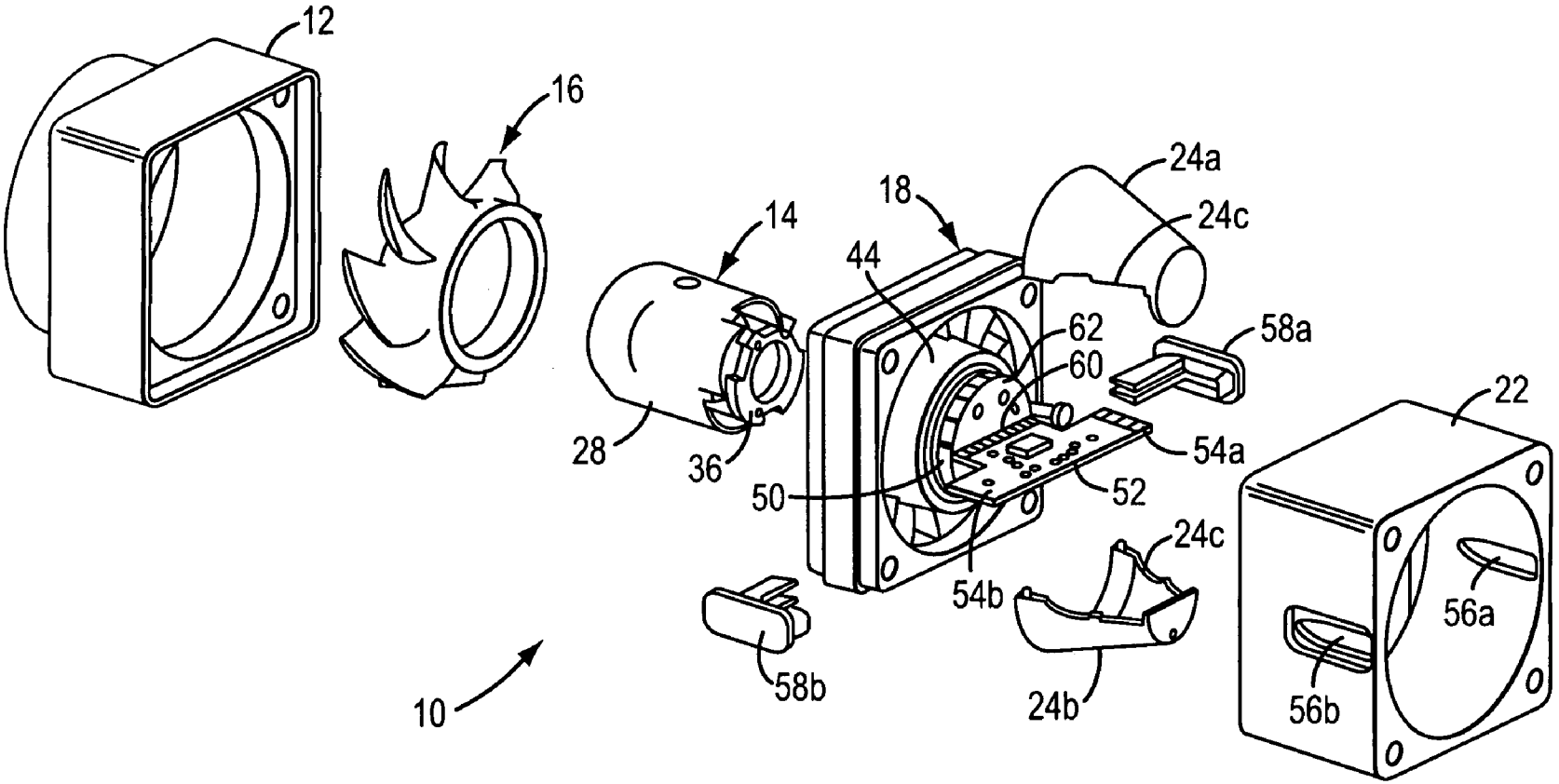
FIG. 1 is an isometric, partially exploded view of one embodiment of the fan of the present invention.
Figure 2:
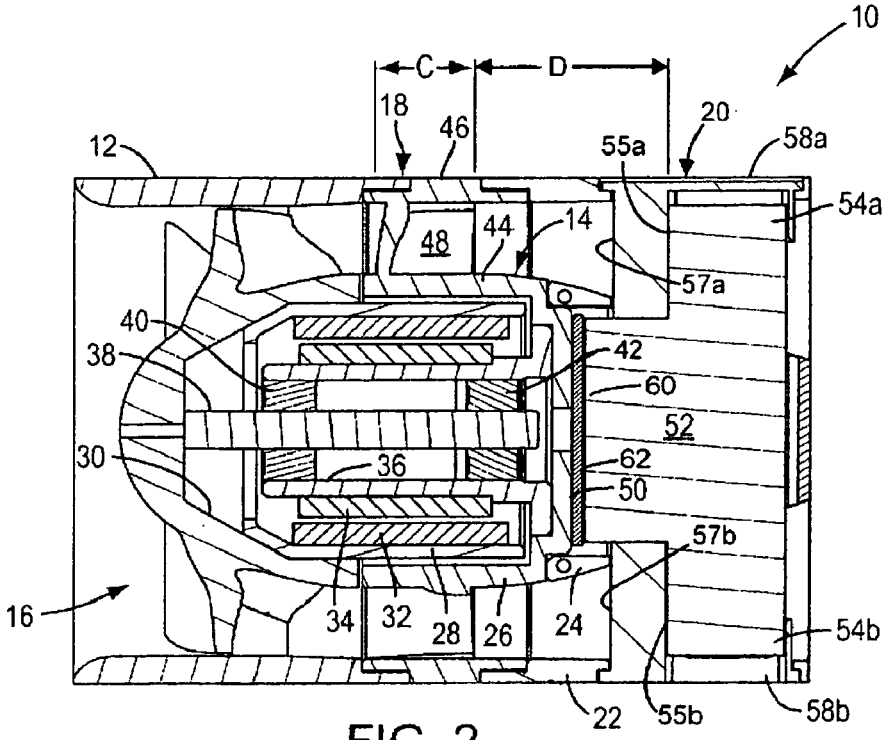
FIG. 2 is cross sectional view of the fan shown in FIG. 1.

Referring to FIGS. 1 and 2, the cooling fan of the present invention, which is indicated generally by reference number 10, includes a fan housing 12, a motor 14, an impeller 16 which is driven by the motor, and an outlet guide vane assembly 18 which is located downstream of the impeller and to which the motor is mounted by known means. The cooling fan 10 may also include a diffuser section 20 which is located downstream of the outlet guide vane assembly and which includes a diffuser tube 22 that is connected to or formed integrally with the fan housing 12 and a tail cone 24 that is connected to or formed integrally with the downstream end of the motor 14.

In this embodiment of the invention, the exterior rotor type motor 14 includes a cylindrical motor housing 26, a rotor cup 28 which comprises a rear portion that is disposed within the housing and a front portion that is mounted in a corresponding recess 30 in the impeller, a permanent magnet 32 which is mounted within the rotor cup, and an inner stator 34 which is mounted to a bearing caddy 36. The impeller 16 is connected to a shaft 38 which is rotationally supported in a pair of front and rear bearings 40, 42 that in turn are mounted in the bearing caddy 36. The outlet guide vane assembly 18 includes an inner hub 44 which is attached to or formed integrally with the motor housing 26, an outer ring 46 to which the fan housing 12 and the diffuser tube 22 are connected, and a plurality of guide vanes 48 which extend radially between the hub and the outer ring.

In operation of the cooling fan 10, the motor 14 spins the impeller 16 to draw air into the fan housing 12 and through the outlet guide vane assembly 18 and the diffuser section 20. As the air stream passes through the outlet guide vane assembly 18, the guide vanes 48 turn the air steam into the axial direction and, in the process, increase the static pressure of the air. The diffuser section 20 then decelerates the air stream to further increase the static pressure of the air.

In the embodiment of the invention shown in FIGS. 1 and 2, the motor housing 26 includes a downstream end wall 50 to which the bearing caddy 36 is connected by suitable means. Thus, since the hub 44 of the outlet guide vane assembly 18 is attached to or formed integrally with the motor housing 26, in addition to de-swirling the air stream, the guide vanes 48 serve to support the bearing caddy 36 and, thus, the motor 14 within the fan housing 12. However, the guide vanes 48 may not be strong enough to support the motor 14 by themselves. Therefore, one or more radial struts may be needed to help support the motor 14 within the fan housing 12.

In accordance with the present invention, the cooling fan 10 comprises one or more radial struts which are made from a substrate on which at least some, and ideally most or all, of the electronics components for the motor 14 are mounted. The struts may be similar to the struts used in prior art fans to support the internal fan components, such as the motor or the tail cone, within the fan housing. In addition, the number of struts required to mount the electronics components may vary from one to two or more.

In the particular embodiment of the invention shown in FIGS. 1 and 2, for example, the fan 10 comprises a single strut 52 which extends between diametrically opposite portions of the diffuser tube 22. The strut 52 comprises first and second radially opposite ends 54*a*, 54*b* which are each positioned adjacent or in a corresponding orifice 56*a*, 56*b* in the diffuser tube 22. The strut 52 is secured to the diffuser tube 22 by a pair of strut holders 58*a*, 58*b*, each of which is fittingly received in a corresponding one of the orifices 56*a*, 56*b* and is secured therein by suitable means, such as gluing.

The strut 52 comprises a central edge 60 which is soldered or otherwise electrically connected to a transverse daughter board 62. The daughter board 62 in turn is connected to the downstream end wall 50 of the motor housing 26 by screws or other suitable means. In addition, the tail cone 24 may be comprised of two pieces 24*a*, 24*b* which are secured together over the strut 52 and then connected to the motor housing 26 by suitable means. The tail cone pieces 24*a*, 24*b* include recessed edges 24*c* to accommodate both the strut 52 and the electronics components mounted thereon.

Thus, the strut 52 is rigidly coupled to both the diffuser tube 22 and the motor housing 26. Consequently, the strut 52 will aid the guide vanes 48 in supporting the motor 14 and, thus, the impeller 16 within the fan housing 12. The utilization of such a downstream support structure in this manner will greatly increase the natural frequency of the support structure, which in turn will reduce vibration in the cooling fan 10.

The strut 52 may comprise a conventional printed circuit board on which the electronic components are mounted in a conventional fashion. In addition, the daughter board 62 may contain solder pads or the like to which the leads from the motor 14 may be connected. The electronics components which are mounted on the strut 52 may include some or all of the power electronics components for the motor 14, such as the power switches, the driver integrated circuits, the current sense resistors and the filter capacitors. These components generate a significant amount of heat during operation of the motor 14. However, by mounting these components on the strut 52, they are exposed to and thereby cooled by the air stream moving through the fan 10. In addition, because the present invention eliminates the need to mount these components in a cylindrical volume behind the motor 14, the motor 14 can be made larger and more efficient, and still fit within the desired flow path.

The spacing of the strut 52 relative to the guide vanes 48 is an important feature of the present invention. As shown in FIG. 2, the strut 52 comprises a pair of leading edges 55*a*, 55*b*, each of which extends transversely from the central edge portion 60 to a corresponding end 54*a*, 54*b* of the strut. In FIG. 2, the letter D designates the axial distance between the leading edges 55*a*, 55*b*of the strut 52 and the trailing edge of the guide vanes 48. If the distance D between the leading edge edges 55*a*, 55*b* of the strut 52 and the trailing edge of the guide vanes 48 is too small relative to the axial chord C of the guide vanes, the effectiveness of the guide vanes will be diminished and the fan will incur additional flow losses. If this distance D is too large, the size of the strut 52 may be insufficient for all of the required or desired electronics components and interconnects. Therefore, in accordance with the present invention, the ratio of the distance D to the axial chord C of the guide vanes 48 is between about 0.8 and 1.2. More preferably, the ratio of the distance D to the axial chord C is between about 0.9 and 1.1. Most preferably, the ratio of the distance D to the axial chord C is 1.

Figure 3:
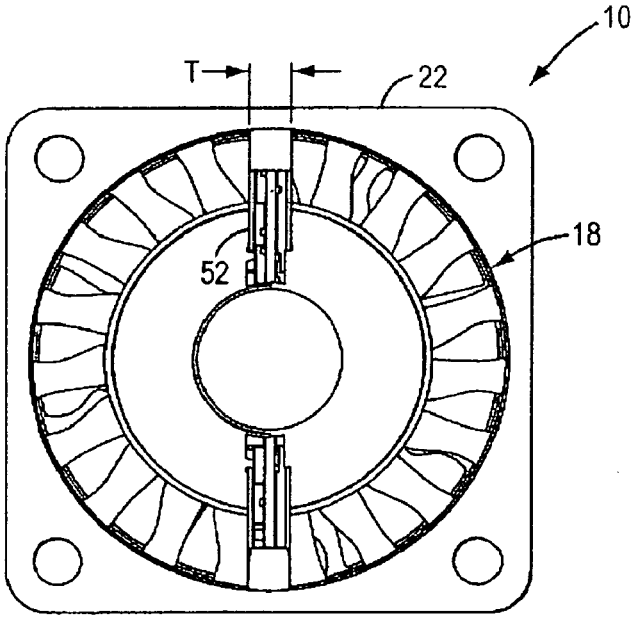
FIG. 3 is a rear elevation view of the fan shown in FIG. 1.

Referring also to FIG. 3, it can be seen that the cross sectional area occupied by the strut 52 is small relative to the flow area. In order not to interfere with the performance of the fan 10, the maximum thickness T of the strut 52 should be less than or equal to about 0.5 times the distance D between the leading edge of the strut and the trailing edge of the guide vanes 48, more preferably less than or equal to about 0.35 times the distance D, and most preferably less than or equal to about 0.25 times the distance D. In addition, the leading edge of the strut 52 is ideally elliptical to help streamline the flow of air over the electronics components in order to reduce losses. The leading edge may also be oriented to accept any incidence angle the air stream has with the strut 52.

Figure 4:
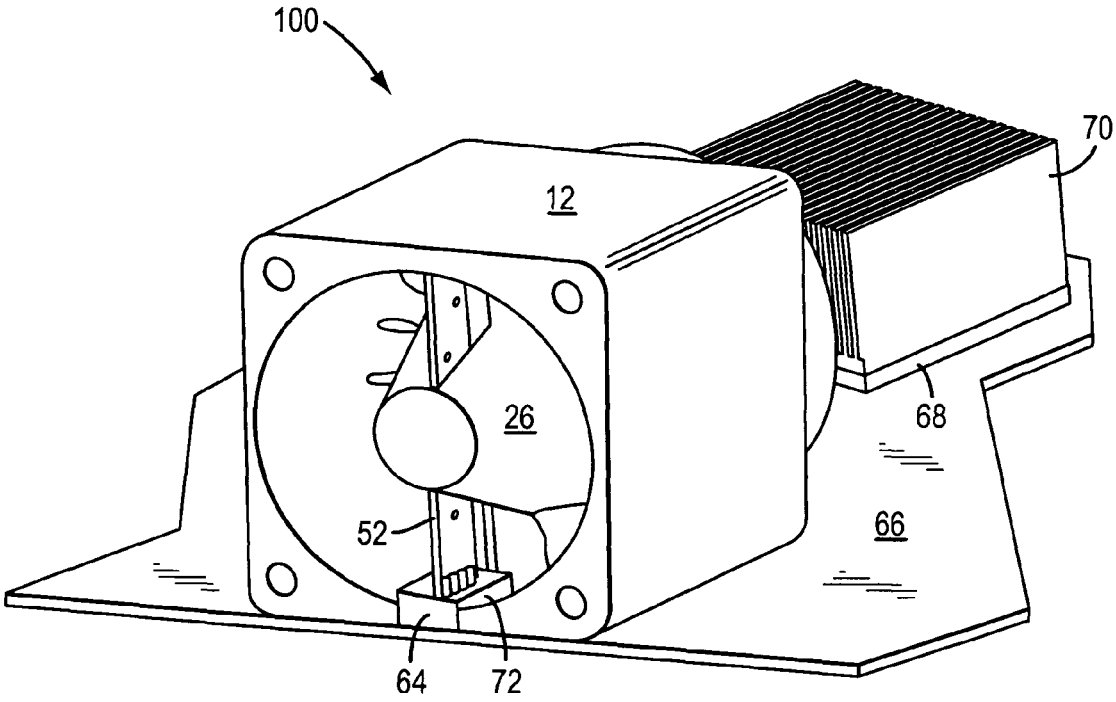
FIG. 4 is perspective view of a second embodiment of the fan of the present invention.

Another embodiment the present invention is illustrated in FIG. 4. The fan of this embodiment, which is indicated generally by reference number 100, is similar in may respects to the fan 10 described above. In this embodiment, however, the strut 52 is designed to interface directly with an edge connector 64 on a mother board 66. As shown in FIG. 4, the mother board contains a number of electronic components 68 which must be actively cooled and which may or may not be coupled to corresponding heat sink structures 70. The strut 52 contains printed solder pads 72 which both mechanically and electrically connect the fan 100 to the mother board 66 in a manner known in the art.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

We claim:

1. A cooling fan which comprises:

a fan housing which includes a central axis;

a motor which is positioned within the fan housing;

an impeller which is rotated by the motor to generate an air stream through the fan housing;

a plurality of power electronics components which are associated with the motor; and at least one generally planar strut which is oriented generally parallel to the central axis, the strut comprising a central edge portion which is secured to the motor and first and second radially opposite end portions which are secured to the fan housing or to a diffuser tube which is connected to a downstream end of the fan housing;

wherein at least some of the power electronics components are mounted on the strut in the path of the air stream.

2. The cooling fan of claim 1, wherein the motor comprises a motor housing and the central edge portion is secured to a downstream end of the motor housing.

3. The cooling fan of claim 2, further comprising:

an outlet guide vane assembly which includes an inner hub that is connected to or formed integrally with the motor housing, an outer ring which is connected to or formed integrally with the fan housing, and a plurality of guide vanes which extend radially between the inner hub and the outer ring;

wherein the motor is supported within the fan housing by both the outlet guide vane assembly and the strut.

4. The cooling fan of claim 1, wherein the first and second end portions are secured to the diffuser tube.

5. The cooling fan of claim 4, wherein the diffuser tube comprises part of a diffuser section which includes a tail cone that is connected to a downstream end of the motor over a portion of the strut located between the first and second end portions.

6. The cooling fan of claim 1, wherein the motor comprises a circuit board which is connected to a downstream end of the motor perpendicular to the central axis, and wherein the central edge portion is secured to the circuit board.

7. The cooling fan of claim 6, further comprising a tail cone which is positioned over a portion of the strut located between the first and second end portions and is connected to the downstream end of the motor over the circuit board.

8. The cooling fan of claim 1, wherein the strut comprises a first printed circuit board on which the power electronics components are mounted.

9. The cooling fan of claim 8, wherein the first end portion of the strut is mechanically and electrically connectable to an edge connector which is mounted on a second printed circuit board.

10. The cooling fan of claim 1, wherein each of the first and second end portions is received in a corresponding strut holder which is secured to the fan housing or to a diffuser tube which is connected to or formed integrally with the fan housing.

11. A cooling fan which comprises:

a fan housing which includes a central axis;

a motor which is positioned in the fan housing, the motor comprising a motor housing;

an impeller which is rotated by the motor to generate an air stream through the fan housing;

an outlet guide vane assembly which includes an inner hub that is connected to or formed integrally with the motor housing, an outer ring which is connected to or formed integrally with the fan housing, and a plurality of guide vanes which extend radially between the inner hub and the outer ring;

a plurality of power electronics components which are associated with the motor; and at least one generally planar strut which is oriented generally parallel to the central axis, the strut comprising a central edge portion which is secured to the motor and first and second radially opposite end portions which are secured to the fan housing or to a diffuser tube which is connected to a downstream end of the fan housing;

wherein at least some of the power electronics components are mounted on the strut in the path of the air stream.

12. The cooling fan of claim 11, wherein the strut comprises first and second leading edge portions which each extend radially between the central edge portion and a corresponding end portion, the leading edge portions define an upstream edge of the strut, the guide vanes comprise a downstream edge, and the ratio of the axial distance between the upstream and downstream edges to an axial chord of the guide vanes is between about 0.8 and 1.2.

13. The cooling fan of claim 12, wherein the ratio of the axial distance between the upstream and downstream edges to the axial chord is between about 0.9 and 1.1.

14. The cooling fan of claim 12, wherein the ratio of the axial distance between the upstream and downstream edges to the axial chord is about 1.

15. The cooling fan of claim 11, wherein the strut comprises first and second leading edge portions which each extend radially between the central edge portion and a corresponding end portion, the leading edge portions define an upstream edge of the strut, the guide vanes comprise a downstream edge, and the strut-comprises a transverse thickness which is less than or equal to about 0.5 times the axial distance between the upstream and downstream edges.

16. The cooling fan of claim 15, wherein the strut comprises a transverse thickness which is less than or equal to about 0.35 times the axial distance between the upstream and downstream edges.

17. The cooling fan of claim 15, wherein the strut comprises a transverse thickness which is less than or equal to about 0.25 times the axial distance between the upstream and downstream edges.

18. The cooling fan of claim 11, wherein the motor comprises a circuit board which is connected to a downstream end of the motor housing perpendicular to the central axis, and wherein the central edge portion is secured to the circuit board.

19. The cooling fan of claim 18, further comprising a tail cone which is positioned over a portion of the strut located between the first and second end portions and is connected to the downstream end of the motor housing over the circuit board.

20. The cooling fan of claim 11, wherein the strut comprises a first printed circuit board on which the power electronics components are mounted.

21. The cooling fan of claim 20, wherein the first end portion of the strut is mechanically and electrically connectable to an edge connector which is mounted on a second printed circuit board.

22. The cooling fan of claim 11, wherein the first and second end portions are secured to the diffuser tube comprising part of a diffuser section which includes a tail cone that is connected to a downstream end of the motor housing over a portion of the strut located between the first and second end portions.

23. The cooling fan of claim 11, wherein each of the first and second end portions is received in a corresponding strut holder which is secured to the fan housing or to the diffuser tube which is connected to or formed integrally with the fan housing.

24. A cooling fan which comprises:

a fan housing which includes a central axis;

a motor which is positioned in the fan housing, the motor comprising a motor housing;

an impeller which is rotated by the motor to generate an air stream through the fan housing;

an outlet guide vane assembly which includes an inner hub that is connected to or formed integrally with the motor housing, an outer ring which is connected to or formed integrally with the fan housing, and a plurality of guide vanes which extend radially between the inner hub and the outer ring;

a diffuser section which includes a diffuser tube that is connected to or formed integrally with the outer ring and a tail cone that is connected to or formed integrally with the motor housing;

a plurality of electronics components which are associated with the motor; and at least one generally planar strut which is oriented generally parallel to the central axis, the strut comprising a central edge portion which is secured to the motor housing and first and second radially opposite end portions which are secured to at least one of the fan housing, the outer ring and the diffuser tube;

wherein at least some of the electronics components are mounted on the strut in the path of the air stream.

25. The cooling fan of claim 24, wherein the strut comprises first and second leading edge portions which each extend radially between the central edge portion and a corresponding end portion, the leading edge portions define an upstream edge of the strut, the guide vanes comprise a downstream edge, and the ratio of the axial distance between the upstream and downstream edges to an axial chord of the guide vanes is between about 0.8 and 1.2.

26. The cooling fan of claim 25, wherein the ratio of the axial distance between the upstream and downstream edges to the axial chord is between about 0.9 and 1.1.

27. The cooling fan of claim 25, wherein the ratio of the axial distance between the upstream and downstream edges to the axial chord is about 1.

28. The cooling fan of claim 24, wherein the strut comprises first and second leading edge portions which each extend radially between the central edge portion and a corresponding end portion, the leading edge portions define an upstream edge of the strut, the guide vanes comprise a downstream edge, and the strut comprises a transverse thickness which is less than or equal to about 0.5 times the axial distance between the upstream and downstream edges.

29. The cooling fan of claim 28, wherein the strut comprises a transverse thickness which is less than or equal to about 0.35 times the axial distance between the upstream and downstream edges.

30. The cooling fan of claim 28, wherein the strut comprises a transverse thickness which is less than or equal to about 0.25 times the axial distance between the upstream and downstream edges.

31. The cooling fan of claim 24, wherein the motor comprises a circuit board which is connected to a downstream end of the motor housing perpendicular to the central axis, and wherein the central edge portion is secured to the circuit board.

32. The cooling fan of claim 31, wherein the tail cone is positioned over a portion of the strut located between the first and second end portions and is connected to the downstream end of the motor housing over the circuit board.

33. The cooling fan of claim 24, wherein the strut comprises a first printed circuit board on which the electronics components are mounted.

34. The cooling fan of claim 33, wherein the first end portion of the strut is mechanically and electrically connectable to an edge connector which is mounted on a second printed circuit board.

35. The cooling fan of claim 24, wherein the tail cone is connected to a downstream end of the motor housing over a portion of the strut located between the first and second end portions.

36. The cooling fan of claim 24, wherein each of the first and second end portions is received in a corresponding strut holder which is secured to at least one of the fan housing, the outer ring and the diffuser tube.

* * * * *